US007641135B1

(12) United States Patent
Lo

(10) Patent No.: US 7,641,135 B1
(45) Date of Patent: Jan. 5, 2010

(54) COMBINATIVE CUTTING WHEEL OF A ROTARY CUTTER OF PAPER SHREDDER

(76) Inventor: Emily Lo, No. 18, Lane 20, Hsin Feng Street, Hsin Chuang City, Taipei Shien (TW)

( * ) Notice: Subject to any disclaimer, the term of this patent is extended or adjusted under 35 U.S.C. 154(b) by 575 days.

(21) Appl. No.: 11/365,738

(22) Filed: Feb. 28, 2006

(51) Int. Cl.
*B02B 7/02* (2006.01)
*B02C 23/00* (2006.01)

(52) U.S. Cl. ..... 241/100; 241/236; 241/295

(58) Field of Classification Search ..... 241/295, 241/100, 236
See application file for complete search history.

(56) References Cited

U.S. PATENT DOCUMENTS

| | | | | | |
|---|---|---|---|---|---|
| 714,182 | A * | 11/1902 | Hoover | 241/295 |
| 3,323,567 | A * | 6/1967 | Segal | 144/223 |
| 3,675,526 | A * | 7/1972 | Bush | 83/676 |
| 3,852,843 | A * | 12/1974 | Metz | 15/93.1 |
| 4,561,156 | A * | 12/1985 | Sun | 241/294 |
| 4,934,611 | A * | 6/1990 | Lewis | 241/36 |
| 5,048,767 | A * | 9/1991 | Mori | 241/236 |
| 5,135,178 | A * | 8/1992 | Strohmeyer | 241/295 |
| 5,680,999 | A * | 10/1997 | Wada | 241/236 |
| 6,390,400 | B1 * | 5/2002 | Huang | 241/295 |
| 6,854,676 | B2 * | 2/2005 | Dubech et al. | 241/236 |
| 7,000,859 | B2 * | 2/2006 | Tuovinen | 241/294 |
| 7,438,247 | B2 * | 10/2008 | Leclercq | 241/293 |
| 7,469,852 | B2 * | 12/2008 | Sharp | 241/236 |
| 7,510,135 | B2 * | 3/2009 | Burchardt et al. | 241/294 |
| 2004/0251360 | A1 * | 12/2004 | Everson et al. | 241/294 |

* cited by examiner

*Primary Examiner*—Bena Miller
(74) *Attorney, Agent, or Firm*—Pro-Techtor Int'l Services

(57) ABSTRACT

A combinative cutting wheel of a rotary cutter of paper shredder is composed of two sets of edge rings having cutting edges on outer rings thereof, and a plastic base ring having a spacer. A center of the aforementioned plastic base ring is provided with a shaft hole which can fit with a polygonal shaft rod. The two sets of edge rings are abutted on each other and then latched on the plastic base ring to form an integral body. The two edge rings constituting the cutting wheel are pre-installed on the plastic base ring having the spacer to form an integrated cutting wheel having the spacer, enabling the two blades and the spacer which would be installed separately to become one component, so as to simplify an assembling procedure for the rotary cutter. As the plastic base ring made by a light material is used to replace a main body of blade for the assembled structure using the edge rings and the plastic base ring, an original paper-cutting function of the cutting wheel will not be affected, and an amount of steel material to be used can also be decreased to reduce a weight of the cutting wheel, thereby reducing an entire weight of the rotary cutter after being assembled.

4 Claims, 2 Drawing Sheets

COMBINATIVE CUTTING WHEEL OF A ROTARY CUTTER OF PAPER SHREDDER

BACKGROUND OF THE INVENTION a) Field of the Invention

The present invention relates to a cutting tool of a paper shredder, and more particularly to a combinative cutting wheel of a rotary cutter of paper shredder.

b) Description of the Prior Art

It is well known that an existing cutting tool of paper shredder is composed of a pair of rotary cutters that rotate in a reversed direction. The rotary cutter is assembled from a shaft rod and a plurality of cutting wheels that are sheathed on the shaft rod and are spaced apart with one another by a spacer. The aforementioned cutting wheel is formed by two blades abutted on each other, and the blades which are integrally formed by punching are used for all of the existing cutting wheels. A periphery of blade is formed with a plurality of protruded cutting edges and a center of blade is provided with a shaft hole which can fit with the polygonal shaft rod. The aforementioned blade is usually made of a steel plate in a larger diameter through a technique of one-time punching. Disregarding its size of diameter, this kind of blade should be made by punching the individual steel plate respectively, thereby requiring a lot of materials in installation. Upon assembling the rotary cutter, two sets of blades which constitute the cutting wheel should be abutted on each other and then alternately installed on the shaft rod, separated by the spacers sheathed between each cutting wheel. The rotary cutter of this kind of structure is provided with the following shortcomings:

1. As there are a lot of blades and spacers which are alternately aligned and assembled on the shaft rod, it is very complicated and time consuming in assembling, thereby having a low efficiency of assembling.

2. As the blade is totally a steel structure, a lot of wasted materials will be created and a heavier rotary cutter will usually be formed.

SUMMARY OF THE INVENTION

Accordingly, the primary object of present invention is to provide a combinative cutting wheel of a rotary cutter of paper shredder, which can sufficiently utilize a blade material, decrease a weight of rotary cutter after being assembled, simplify a procedure of assembling operation, and effectively increase an efficiency of assembling.

The combinative cutting wheel of present invention is constituted by two sets of edge rings having cutting edges on outer rings thereof, and a plastic base ring having a spacer. A center of the aforementioned plastic base ring is provided with a shaft hole which can fit with a polygonal shaft rod. The two sets of edge rings are abutted on each other and then latched on the plastic base ring to form an integral body.

An inner ring of the aforementioned edge ring is distributed with projected pins which can be latched into a circumference of the plastic base ring distributed with recesses corresponding to the projected pins in the inner ring of edge ring.

The aforementioned plastic base ring is molded in accordance with the inner rings of two sets of abutted edge rings.

The design principle of the combinative cutting wheel of present invention is that the two edge rings which constitute the cutting wheel are pre-installed on the plastic base ring having the spacer to form an integrated cutting wheel having the spacer, enabling the two blades and the spacer which would be installed separately to become one component, so as to simplify an assembling procedure for the rotary cutter. As the plastic base ring made by a light material is used to replace a main body of blade for the assembled structure using the edge rings and the plastic base ring, an original paper-cutting function of the cutting wheel will not be affected, and an amount of steel material to be used can also be decreased to reduce a weight of the cutting wheel, thereby reducing an entire weight of the rotary cutter after being assembled.

The design of the combinative cutting wheel of present invention is scientific, and the structure is valid and compact, which can reduce a workload for assembling the rotary cutter, improve the efficiency of assembling, and greatly reduce the amount of steel material to be used and the weight of cutting wheel. As the two sets of blades which constitute the cutting wheel are all edge rings, a wasted material from punching the inner ring of larger edge ring can be at least used to manufacture a smaller paper-shredding blade. In other words, a smaller blade can be directly produced during a procedure of punching a larger edge ring, enabling the steel material to be sufficiently used to save materials, and also greatly improving the punching efficiency of blade.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
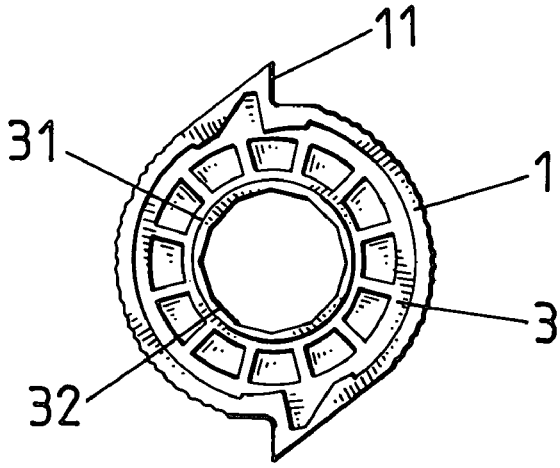
FIG. 1 shows a schematic view of a combinative cutting wheel of a rotary cutter of paper shredder of the present invention.
Figure 2:
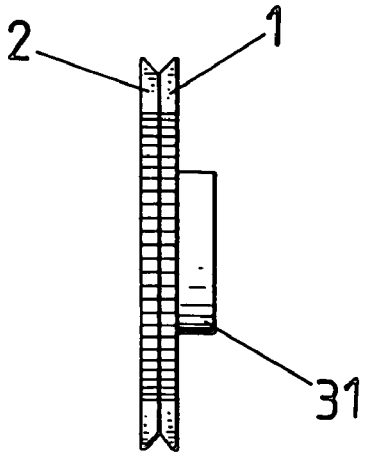
FIG. 2 shows a left side view of a combinative cutting wheel of a rotary cutter of paper shredder of the present invention.
Figure 3:
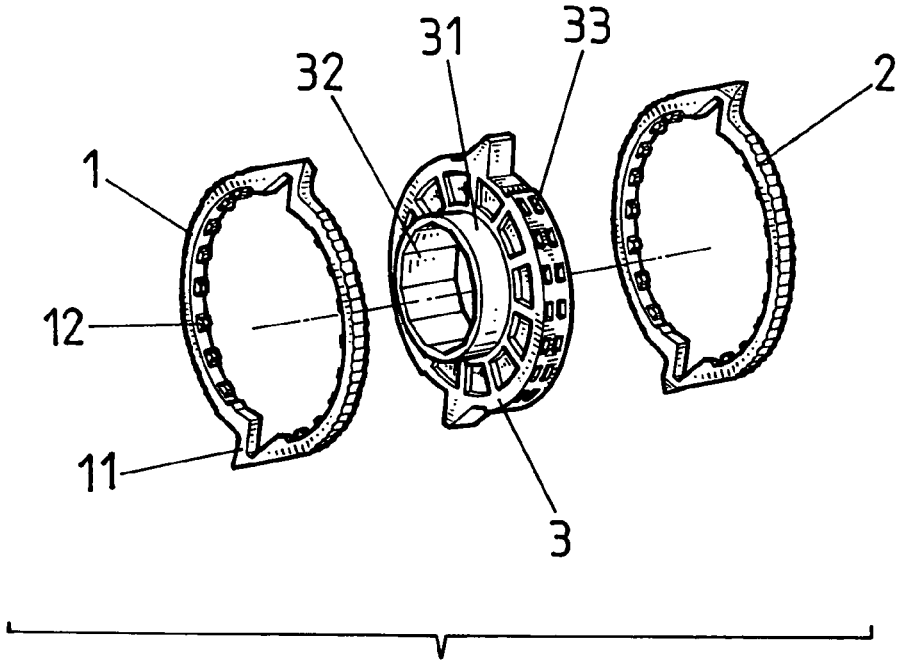
FIG. 3 shows an exploded view of a combinative cutting wheel of a rotary cutter of paper shredder of the present invention.

Referring to FIG. 1 and FIG. 2, a combinative cutting wheel of a rotary cutter of paper shredder of the present invention comprises two sets of edge rings 1, 2, and a plastic base ring 3 having a spacer 31. Referring to FIG. 3, outer rings of the aforementioned edge rings 1, 2 are all formed with cutting edges 11, and inner rings are all distributed with projected pins 12 which can be latched into a circumference of the plastic base ring 3. A center of the plastic base ring 3 is provided with a shaft hole 32 which can fit with a polygonal shaft rod, and the circumference of plastic base ring 3 is distributed with recesses 33 which are corresponding to the projected pins 12 in the inner rings of edge rings 1, 2. The two sets of edge rings 1, 2 are abutted on each other and then latched on the plastic base ring 3 to form an integral body. By fitting the projected pins 12 on the inner rings of edge rings 1, 2 with the recesses 33 at the circumference of plastic base ring 3, it can assure that there will be no radial or axial movement between the edge ring and the plastic base ring.

The aforementioned plastic base ring 3 is molded in accordance with the inner rings of two abutted edge rings 1, 2.

The combinative cutting wheel of present invention can be directly assembled on a shaft, without requiring an installation of separate spacer between each cutting wheel.

Figure 4:
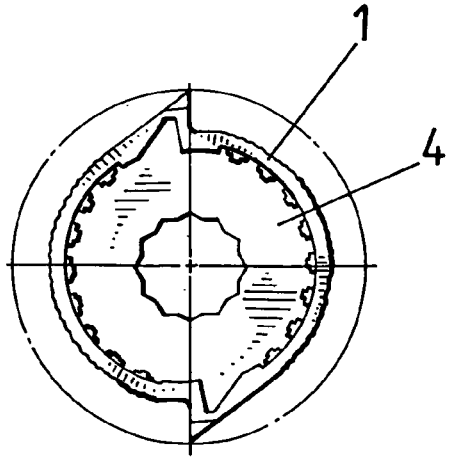
FIG. 4 shows a schematic view of an edge ring and a smaller blade sharing a piece of steel plate.

The edge rings 1, 2 used for the combinative cutting wheel of present invention enables a sufficient utilization of blade material. Referring to FIG. 4, as the two sets of blades which constitute the cutting wheel are all edge rings, a wasted material from punching a larger edge ring can be at least used to manufacture a smaller paper-shredding blade. In other words, a smaller blade can be produced in punching a larger edge ring 1. As shown in FIG. 3, the wasted material after punching the edge ring 1 of single blade of the assembled structure is just a piece of single blade 4 of an existing structure.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A combinative cutting wheel of a rotary cutter of paper shredder, said combinative cutting wheel comprising at least one continuous outer edge ring having cutting edges on an outer periphery thereof; and an inner plastic base ring having a spacer, said base ring being provided with a central shaft hole which is shaped to fit a polygonal shaft rod and an outer periphery shaped to fit said inner periphery of said outer ring;

wherein inner peripheral surfaces of said edge rings are distributed with inwardly projected pins which are latchable unto the outer periphery of the plastic base ring thereby forming an integral cutting disk.

2. The combinative cutting wheel of a rotary cutter of paper shredder according to claim 1, wherein the outer periphery of the plastic base ring is distributed with recesses which are corresponding to the projected pins at the inner peripheral surface of the edge rings;

whereby the inwardly projected pins of the edge rings are latchable into the distributed recesses of the plastic base ring.

3. The combinative cutting wheel of a rotary cutter of paper shredder according to claim 1, wherein the plastic base ring is molded in accordance with the inner peripheral surface of the edge rings.

4. The combinative cutting wheel of a rotary cutter of paper shredder according to claim 1, wherein the spacer is continuous with the plastic base ring.

* * * * *